United States Patent [19]

Albert

[11] 4,058,281

[45] Nov. 15, 1977

[54] HIGH VACUUM FASTENER

[76] Inventor: Karmen D. Albert, 74-16 58th Ave., Elmhurst, N.Y. 11373

[21] Appl. No.: 696,666

[22] Filed: June 16, 1976

[51] Int. Cl.[2] ..... A45D 42/14; B25B 11/00

[52] U.S. Cl. ..... 248/362; 248/206 R; 269/21; 294/64 R

[58] Field of Search ..... 248/362, 363, 206 R; 269/21; 279/3; 51/235; 294/64 R

[56] References Cited

U.S. PATENT DOCUMENTS

| | | | |
|---|---|---|---|
| 2,916,059 | 12/1959 | Wong | 294/64 R |
| 3,158,381 | 11/1964 | Yamamura | 279/3 |
| 3,907,268 | 9/1975 | Hale | 269/21 |

FOREIGN PATENT DOCUMENTS

| | | | |
|---|---|---|---|
| 683,290 | 11/1952 | United Kingdom | 248/206 R |

OTHER PUBLICATIONS

IBM Technical Disclosure Bulletin, "Vacuum Chuck," W. Von Kaenel, vol. 6, No. 7, p. 61, Dec. 1963.

*Primary Examiner*—Ramon S. Britts
*Attorney, Agent, or Firm*—Allison C. Collard

[57] ABSTRACT

A vacuum device for securement against a flat or shaped surface and capable of maintaining a vacuum against the surface by the use of an external vacuum source consisting of a block having a first smooth surface for contact against the flat surface, wherein the smooth surface of the block has a closed peripheral groove. A sealing means is disposed in the closed peripheral groove defining a vacuum retaining area with the flat or shaped surface. A valve means is disposed in the block and has an inlet accessible on a second block surface and communicative to the vacuum retaining area so that when the air is removed from the retaining area, the external air pressure will force the block against the flat surface. In another embodiment, a further vacuum retaining area is formed with an additional seal which is operative with the same valve, or an independent valve.

7 Claims, 8 Drawing Figures

HIGH VACUUM FASTENER

This invention relates to a vacuum holding device having an air removal valve.

More specifically, this invention relates to the combination of a vacuum holding device and air removal valve capable of maintaining adhesion to flat or shaped surfaces for indefinite periods of time.

In many instances, there is need for holding devices which can attach themselves to smooth surfaces without damaging the surfaces in order to hold and maintain appliances. In the prior art, there are known vacuum holding devices which are used to carry flat sheets of glass and include external handles. These holding devices generally create the necessary vacuum by collapsing a diaphram against the flat surface to evacuate the air within the chamber of the device before the chamber is enlarged with a partial vacuum. These prior art devices are not very satisfactory for long-term securement since they only create a weak partial vacuum which through leakage eventually causes the holding device to be released from the flat surface.

Accordingly, the present invention provides an improvement over the prior art devices in utilizing a rigid chamber holding device in combination with an air removal valve so that an external vacuum pump can withdraw almost all of the air from the rigid chamber to create a permanent seal against the flat surface. In the embodiment of the invention, a rigid block, either rectangular or circular in shape, has a chamber formed in one of its flat surfaces surrounded by a seal or O-ring. Communicative to the vacuum chamber is an air removal valve disposed in the body of the holding device. On another surface from that of the vacuum chamber there may be provided a holding clamp, a hook or other appliance which is needed to support an object on a flat surface. There may also be provided a second opposite vacuum clamp for holding objects on a second surface. Also formed on one surface is the inlet opening for the one-way valve. An external vacuum pump can thus be applied to the inlet of the valve to remove the air from the chamber or chambers as the holding device is lightly pressed against a flat surface. In this manner, it is possible to support heavy objects against metal, glass, tile or any non-porous surfaces, such as those found in bathrooms or around windows where it would be otherwise impractical to drill or apply threaded screws to such surfaces.

It is therefore an object according to the present invention to provide a vacuum holding device having a rigid body with a chamber formed therein and an air removal valve communicative to the chamber.

It is another object according to the present invention to provide a vacuum holding device which is simple in design, reliable in operation and inexpensive in cost.

Other objects and features of the present invention will become apparent from the following detailed description considered in connection with the accompanying drawings which disclose the embodiments of the invention. It is to be understood, however, that the drawings are designed for the purpose of illustration only and not as a definition of the limits of the invention.

In the drawings, wherein similar reference characters denote similar elements throughout the several views.

Figure 8:
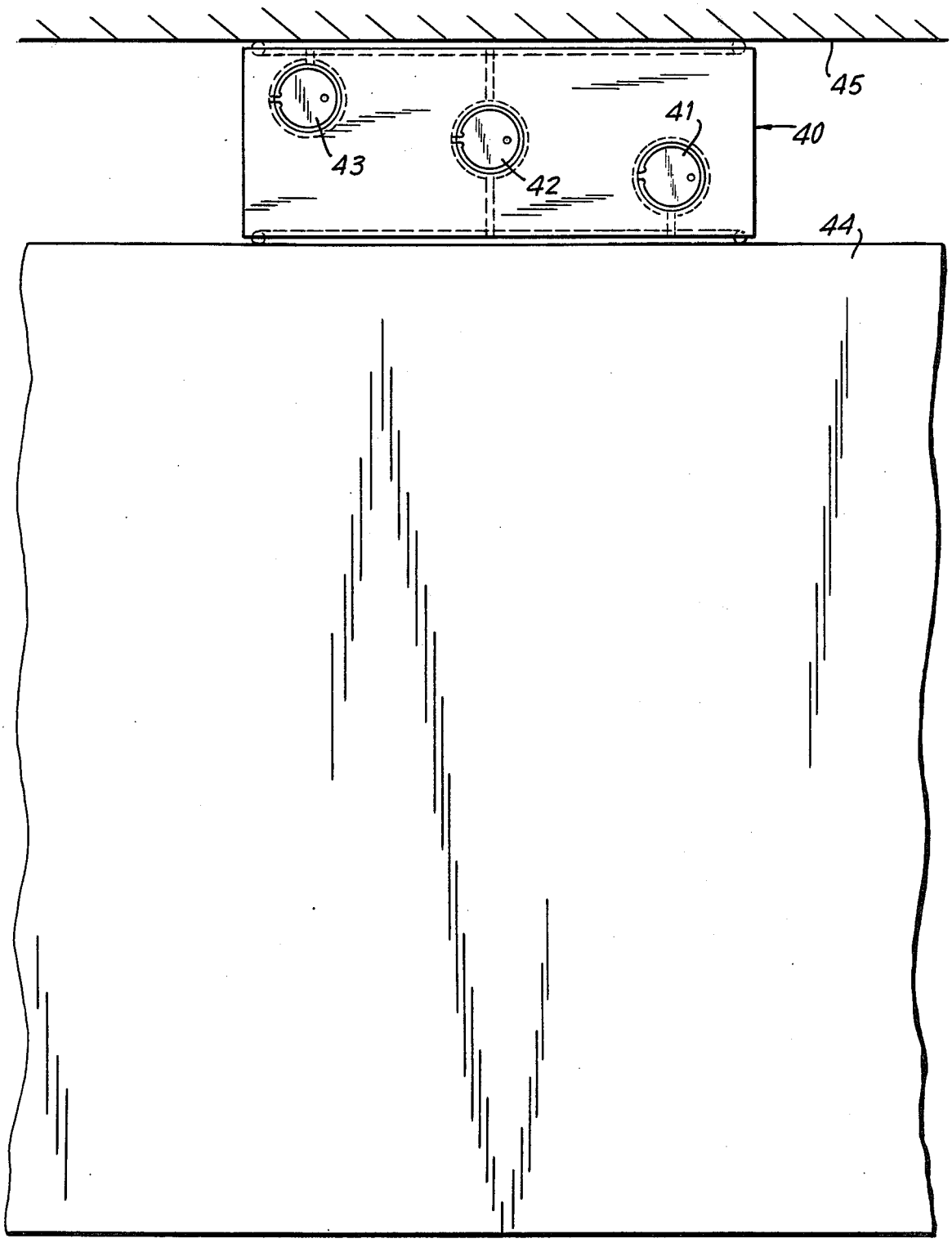

FIG. 8 discloses the use of a double-sided holding device for retaining an object to a surface according to the invention.

Referring to FIGS. 1–4, there is shown a holding block 11 which may be constructed of any rigid material, such as plastic, metal or wood, and of any flat or shaped configuration to fit a particular surface. The valve which is communicative to vacuum chamber 9 is recessed in a bore 10 formed through the top supporting surface of the holding device. Bore 10 is of sufficient depth to accommodate all of the elements of the valve but does not pass completely through into vacuum chamber 9 but terminates adjacent to the wall of the chamber. Fitted into bore 10 is a cap or plug 8 which may be constructed of a metal, rubber or plastic material. On the exposed top surface of plug 8 is formed a cylindrical opening 20 for receiving a needle-type valve pin 24. Cylindrical opening 20 terminates in a chamber 9 at the bottom of plug 8 where it contacts a lever 19. Lever 19 pivots on a fulcrum 18 supported on a post 16 formed by a bracket 6. At the opposite side of lever 19 is formed an elongated slot which is loosely coupled to a pin 12. Pin 12 engages a cylindrical rod 13 which slides in a cylindrical sleeve or cap 15 retained in plug 8. The end of rod 13 is hollowed out to receive the spring 14. Rod 13 is urged toward valve seat O-ring 27 by means of spring 14 in cap 15. At the opposite end of rod 13 is a cylindrical bore having a diameter slightly larger than nozzle 26 which is communicative to a bore 16 which opens to an enclosed vacuum retaining area.

Surrounding the body of block 11 preferably along its peripheral edges is an annular slot for frictionally receiving an O-ring 30, thereby defining the enclosed vacuum retaining area.

In operation, a needle valve pin 24 generally having a connecting end 25 is inserted into cylindrical opening 20. The body of plug 8 forms a seal around the stem of needle valve pin 24 so that when the end of the needle pin contacts lever 19 and causes the lever to rotate in a clockwise direction, the opposite end of lever 19 will raise rod 13 upward against the force of spring 14. This will expose valve seat 27 and its O-ring seal and opening 26 to the enclosed vacuum retaining area. Needle valve opening 32 also lies within chamber 28 so that when a vacuum pump is attached to coupling 25 of the pin, air can be evacuated through opening 16, nozzle 26, chamber 9, and through needle valve opening 32, thereby reducing the air pressure within the enclosed area defined within O-ring 30. Depending upon the strength of the vacuum pump when all of the possible air is removed from the enclosed area, the needle valve pin can be withdrawn from opening 20 so that spring 14 will push against rod 13 to allow its free end to seal across valve seat ring 27 and maintain the vacuum formed within vacuum chamber 9. Valve seat ring 27 is sealed by rod 13 before needle valve pin 24 is withdrawn out of opening 20 so that there is no loss of vacuum by leakage through opening 20.

Figure 1:
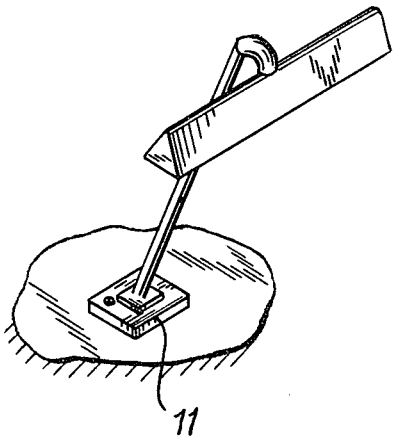
FIG. 1 is a perspective view showing the holding device of the invention supporting a desk lamp to a flat surface.
Figure 2:
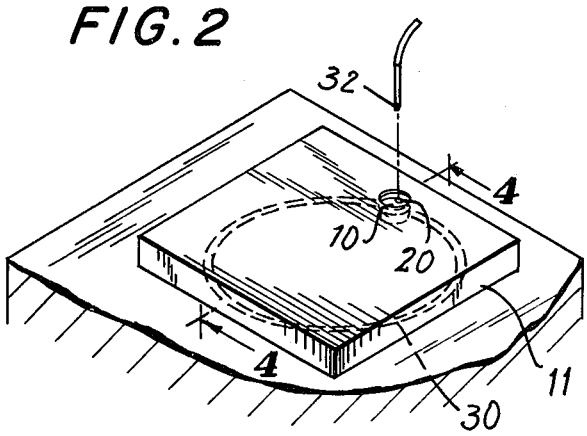
FIG. 2 is an enlarged perspective view showing the holding device and its air removal valve.
Figure 3:
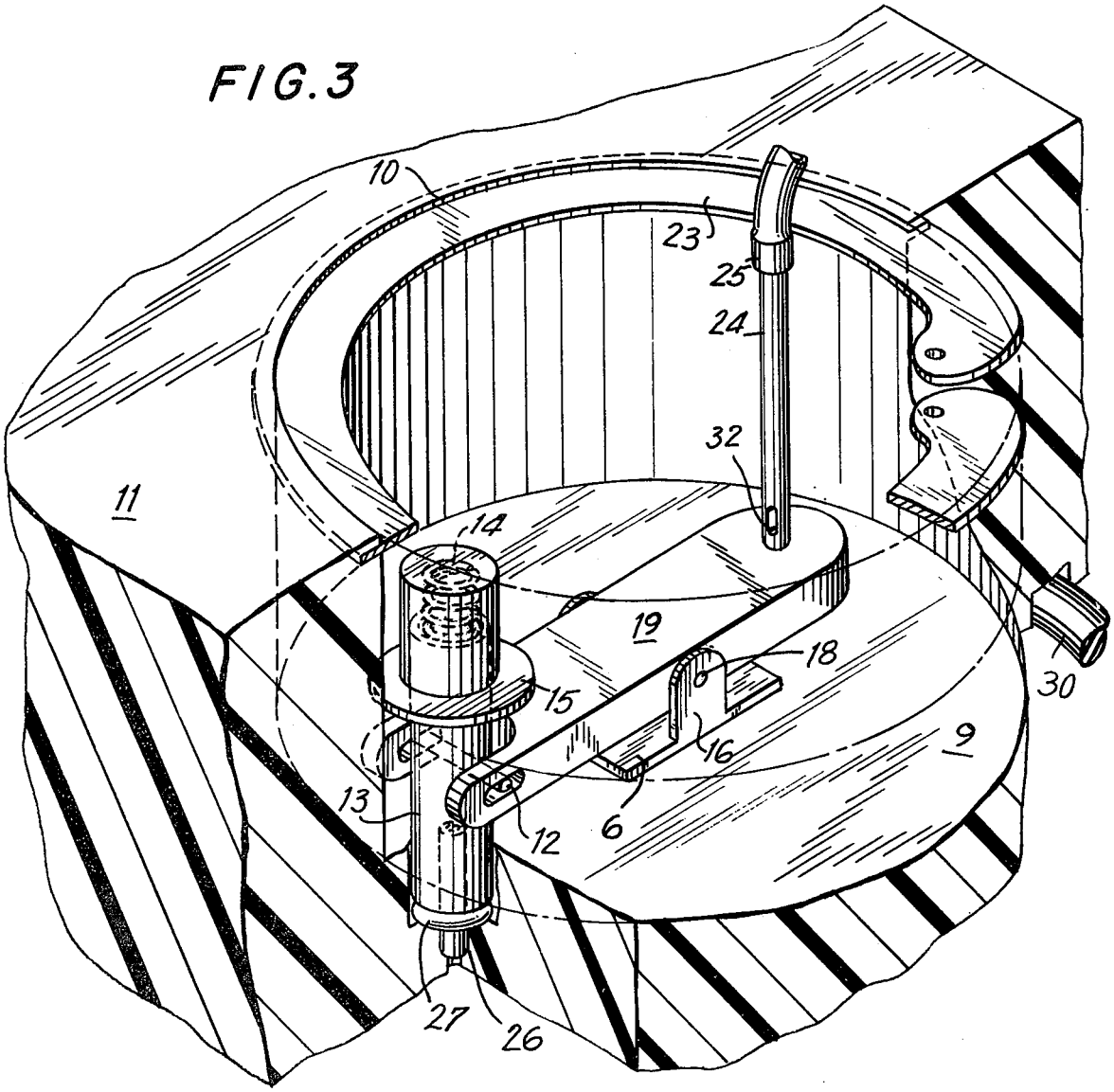
FIG. 3 is a perspective view partly in cross section showing the details of the one-way valve.
Figure 4:
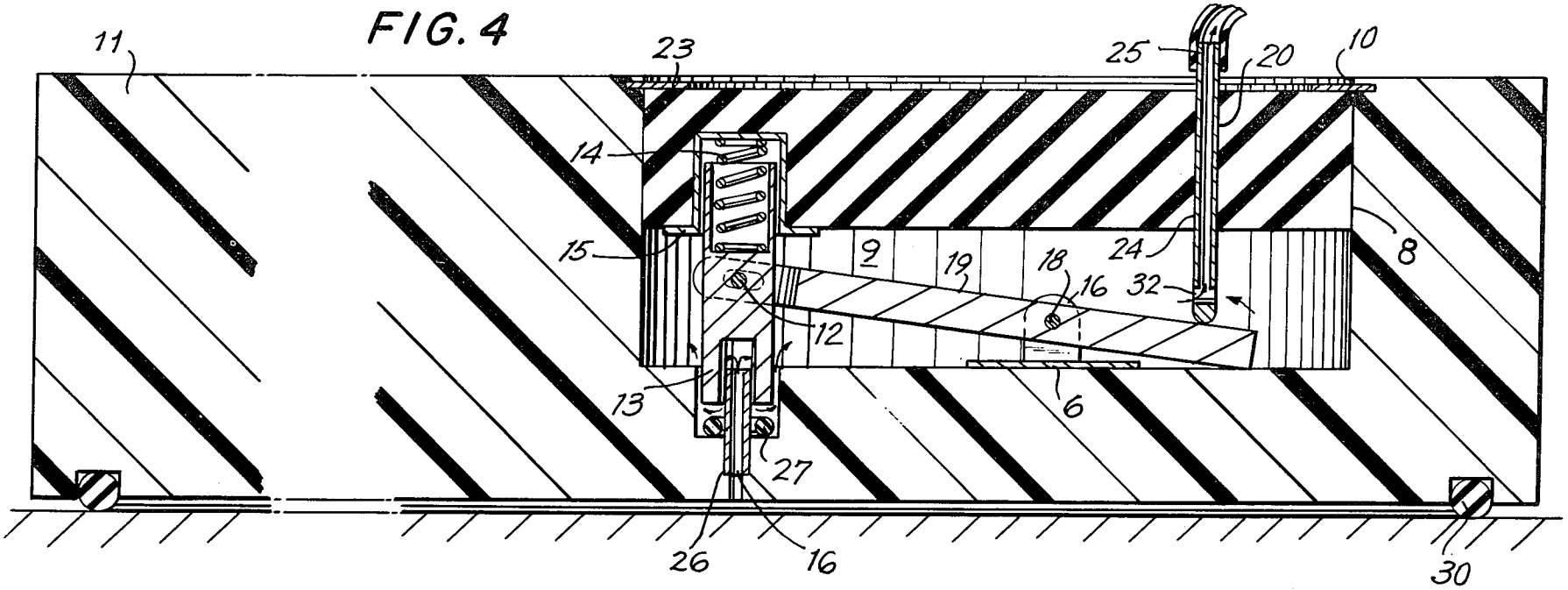
FIG. 4 is a cross-sectional view taken along section 4—4 of FIG. 2.
Figure 7:
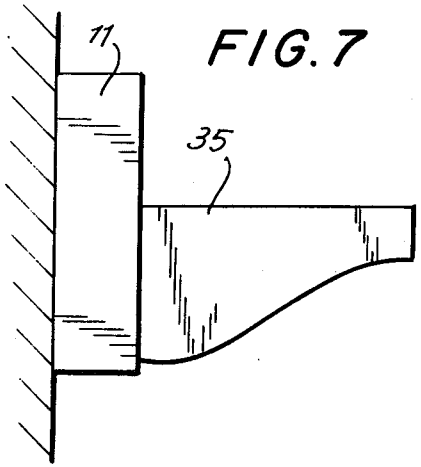
FIG. 7 illustrates the use of a holding device for a shelf.
Figure 6:
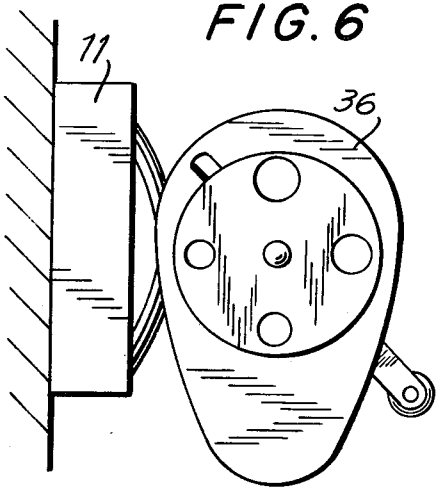
FIG. 6 illustrates the use of a holding device for supporting a pencil sharpener.
Figure 5:
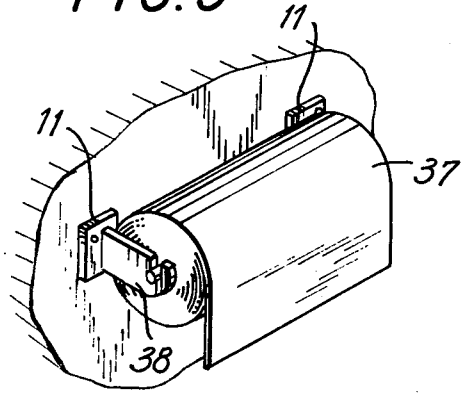
FIG. 5 illustrates the use of a paper towel rack connected to a pair of holding devices according to the invention.

Vacuum block 11 is thus tightly secured by means of air pressure against any flat smooth surface since there is no leakage through sealing O-ring 30. Moreover, the air pressure pushing against the outside of block 11 maintains pressure against O-ring to insure that the seal will remain unbroken. Vacuum block 11 may include one or a plurality of threaded openings formed in its surfaces in which to receive and hold appliances, such as paper towel racks 37 as shown in FIG. 5, pencil sharpeners 36 as in FIG. 6, and a shelf support 37 as shown in FIG. 7. Since the air pressure exerts a full force of approximately 15 lbs. per square inch against the outer surface of the block, an O-ring 30 defining an area of only 4 square inches would have a force of 60 lbs., maintaining the block against a wall surface.

The body of block 11 may be constructed of any suitable material, such as plastic or metal, which is capable of receiving and holding and maintain its dimensional stability under the applied air pressure. Its thickness should be sufficient to receive plug 8. Plug 8 is preferably constructed of a rubber material. Rod 13 is preferably constructed of a rigid material, such as brass or plexiglass or molded plastic. Lever 19 is preferably of a rigid material, such as brass or molded plastic.

FIG. 8 discloses another embodiment of a vacuum holding block 40 having enclosed vacuum retaining areas formed on opposite surfaces for retaining object 44 to surface 45. Double-sided vacuum holding device 40 may have individual valves 41 or 43 for evacuating the lower or upper retaining areas, respectively, or a single valve 42 connected to both retaining areas for simultaneously evacuating both surfaces.

While only two embodiments of the invention have been shown and described, it will be obvious that many changes and modifications may be made thereunto without departing from the spirit and scope of the invention.

What is claimed is:

1. A vacuum device for securement against a flat surface and capable of maintaining a vacuum against the surface by means of an external vacuum source comprising:

a block having a smooth first surface for contact against the flat surface, said smooth surface having a closed peripheral groove;

sealing means disposed in said closed peripheral groove defining a vacuum retaining area with the flat surface; and valve means disposed in said block and having an inlet accessible on a second block surface and communicative to said vacuum retaining area, said valve means including a valve plug disposed within said block, an inlet port disposed in said valve plug for receiving an elongated valve pin, nozzle means secured within said block and communicative to the vacuum-retaining area formed between said first block surface and the flat surface, a valve seat seal surrounding said nozzle means and communicative with said vacuum-retaining area, and means responsive to the insertion of a valve pin in said inlet port for opening said valve seat seal to permit said vacuum-retaining area to be evacuated, and also responsive to the removal of a valve pin from said inlet for closing said valve seat seal to permit maintenance of the vacuum created in said vacuum-retaining area.

2. The vacuum holding device as recited in claim 1 wherein said sealing means comprises an O-ring disposed in said peripheral groove and extending partially out of the plane of said first smooth surface.

3. The holding device as recited in claim 1 wherein said responsive means comprises a lever having one disposed adjacent to said inlet for receiving the inserted valve pin;

a rod pivotably disposed on the opposite end of said lever wherein one end of said rod contacts and seals said valve seal; and a fulcrum disposed between both ends of said lever for permitting said lever to pivot in response to the insertion and removal of said valve pin.

4. The holding device as recited in claim 3 wherein said rod additionally comprises a spring coupled to the opposite end of said rod from said valve seat seal for urging said rod closed against said valve seat seal.

5. The holding device as recited in claim 4 wherein said rod is cylindrically shaped and additionally comprises a cylindrical cap retained in said valve plug for guiding said rod in response to the insertion of the valve pin.

6. The holding device as recited in claim 1 additionally comprising a smooth third surface formed on said block having a closed peripheral groove;

additional sealing means disposed in said closed peripheral groove for defining a further vacuum retaining area within the surface, said further sealing means including an inlet accessible to said valve means.

7. The holding device as recited in claim 1 wherein said block includes a further smooth surface defining a closed peripheral groove;

further sealing means disposed in said closed peripheral groove defining a vacuum retaining area within the flat surface; and additional valve means disposed in said block and having an inlet accessible on a further block surface and communicative to said further vacuum retaining area.

* * * * *